US006945506B2

(12) United States Patent
Long, Sr.

(10) Patent No.: US 6,945,506 B2
(45) Date of Patent: Sep. 20, 2005

(54) CONNECTOR ASSEMBLY FOR INSULATED CONCRETE WALLS

(75) Inventor: Robert T. Long, Sr., Jena, IA (US)

(73) Assignee: Composite Technologies Corporation, Boone, IA (US)

( * ) Notice: Subject to any disclaimer, the term of this patent is extended or adjusted under 35 U.S.C. 154(b) by 7 days.

(21) Appl. No.: 10/381,082

(22) PCT Filed: Sep. 21, 2001

(86) PCT No.: PCT/US01/29851

§ 371 (c)(1),
(2), (4) Date: Aug. 7, 2003

(87) PCT Pub. No.: WO02/25023

PCT Pub. Date: Mar. 28, 2002

(65) Prior Publication Data

US 2004/0011943 A1 Jan. 22, 2004

Related U.S. Application Data

(60) Provisional application No. 60/234,492, filed on Sep. 22, 2000.

(51) Int. Cl.[7] ..... E04G 17/06

(52) U.S. Cl. ..... 249/213; 249/40; 249/190

(58) Field of Search ..... 249/40, 42, 43, 249/190, 213, 216, 91; 52/309.11, 309.17, 404.2

(56) References Cited

U.S. PATENT DOCUMENTS

| | | | | | |
|---|---|---|---|---|---|
| 929,470 | A | * | 7/1909 | Neil | 249/43 |
| 1,767,834 | A | * | 6/1930 | Carlson | 249/43 |
| 1,907,618 | A | * | 5/1933 | Umbach et al. | 249/43 |
| 2,280,647 | A | * | 4/1942 | Hawes | 52/404.2 |
| 2,645,929 | A | * | 7/1953 | Jones | 249/216 |
| 3,238,835 | A | * | 3/1966 | Rosenberg | 52/404.2 |
| 3,328,055 | A | * | 6/1967 | Lang | 249/42 |
| 3,742,670 | A | * | 7/1973 | Byrd, Jr. | 52/404.2 |
| 3,881,769 | A | * | 5/1975 | Metzke | 52/404.2 |
| 3,926,404 | A | * | 12/1975 | Lovisa et al. | 249/213 |
| 4,079,912 | A | * | 3/1978 | Haydock | 249/43 |
| 4,139,975 | A | * | 2/1979 | Baker | 52/404.2 |
| 4,158,938 | A | * | 6/1979 | Meechan et al. | 52/309.11 |
| 4,159,099 | A | * | 6/1979 | Maguire | 249/43 |
| 4,231,541 | A | * | 11/1980 | Strickland | 249/216 |
| 4,288,951 | A | * | 9/1981 | Carlson et al. | 52/404.2 |
| 4,329,821 | A | | 5/1982 | Long et al. | |
| 4,393,634 | A | | 7/1983 | McDermott et al. | |
| 4,393,635 | A | * | 7/1983 | Long | 52/309.11 |
| 4,625,940 | A | * | 12/1986 | Barton | 249/43 |
| 4,829,733 | A | | 5/1989 | Long | |
| 5,405,119 | A | * | 4/1995 | Maguire | 249/190 |
| 5,497,592 | A | | 3/1996 | Boeshart | |
| 5,537,797 | A | * | 7/1996 | Harkenrider et al. | 249/43 |
| 6,112,489 | A | * | 9/2000 | Zweig | 52/309.11 |
| 6,138,981 | A | | 10/2000 | Keith et al. | |
| 6,351,918 | B1 | | 3/2002 | Westra et al. | |
| 6,360,545 | B1 | * | 3/2002 | Goldstone et al. | 52/404.2 |
| 6,434,902 | B1 | * | 8/2002 | Westra | 52/309.17 |

* cited by examiner

*Primary Examiner*—Michael Safavi
(74) *Attorney, Agent, or Firm*—Kent A. Herink; Daniel A. Rosenberg; Emily E. Harris

(57) ABSTRACT

A through-insulation connector assembly for use in the construction of insulated concrete sandwich wall. The connector assembly includes a spool-shaped connector body comprised of two, interconnecting pieces and a tie that engages the connector body. The two pieces of the connector body are installed at the place of manufacture in a sheet of foam insulation board that will be used as the insulation layer in the construction of an insulated concrete sandwich wall.

15 Claims, 11 Drawing Sheets

CONNECTOR ASSEMBLY FOR INSULATED CONCRETE WALLS

This application claims priority to U.S. Provisional Application Ser. No. 60/234,492 filed Sep. 22, 2000.

BACKGROUND OF THE INVENTION

The invention relates generally to insulated concrete sandwich walls and methods of constructing such walls and, more particularly, to a two-piece connector that spans the insulation layer and engages a tie rod that passes through the insulation layer into the concrete layers on either side of the sandwiched insulation layer.

Insulated concrete sandwich walls are well known in the art. Typically, a concrete sandwich wall panel is created by installing a layer of insulating material between two layers of concrete. In order to create a safe assembly capable of resisting handling and service imposed forces, the insulation layer must be penetrated by a connection system that ties the two layers of concrete together.

Insulated concrete sandwich walls typically are constructed as horizontally-cast or vertically-cast assemblies. In both assemblies, the sandwich comprises an exterior concrete layer, an interior concrete layer, and an insulation layer that separates the concrete layers. Also in both assembly types, a plurality of connecting elements pass through the insulation layer and serve to tie the two concrete layers together after the concrete has hardened.

In vertically-cast assemblies, the individual concrete layers of the sandwich are cast between a pair of parallel, vertical forms. These forms may be located at the site of the to-be-completed building (site cast construction), or they may be located at an off-site location and used to cast a part of a building module that will be moved to the building site (modular construction).

In the present art of vertically-cast insulated concrete sandwich walls, the initial fabrication sequence typically begins with the erection of one of the pair of the concrete forms that will form one of the surfaces of the concrete wall being constructed. A grid of reinforcing steel for the first of the concrete layers is positioned adjacent to the forming surface of the concrete form.

A plurality of the through-insulation connectors are installed in the insulation layer and the insulation layer is positioned adjacent the reinforcing steel and parallel to the forming surface. Known systems call for the installation of the through-insulation connectors into a free-standing sheet or board of foam insulation prior to its positioning adjacent the first reinforcing grid. Most through-insulation connectors are comprised of two interlocking pieces that must be assembled from either side of the sheet of foam insulation at the same time. The insulation layer is most commonly of a size, for example, four feet by eight feet, to make it difficult for a single operator to reach from the edge of the insulation layer to position and interlock the two pieces of the connectors.

Since portions of the through-insulation connectors project laterally from both opposing surfaces of the insulation layer, the plurality of projecting elements must be threaded through the grid of the reinforcing steel. A difficulty in this step is that one of the projecting ties may impinge on a portion of the grid and be directed or displaced off-center. If a nearby tie also contacts a portion of the grid and is directed or displaced off-center in a different direction, the insulation layer will bind and may require manipulation of one or more of the projecting ties in order to move the insulation layer into place. The reinforcing steel grid for the other concrete layer is next positioned adjacent the opposite side of insulation layer and, again, the projections on the opposite side of the insulation layer must be threaded through the second reinforcing steel grid. The second of the pair of concrete forms is put into place, and concrete is poured on either side of the insulation layer. The through-insulation connectors include flanges or other structure which will engage and hold the insulation layer in position during pouring of the plastic concrete.

There is, accordingly, a need for a through-insulation connector assembly which would not only make it easier to assemble the connectors during construction of the wall, but also simplify the construction process. Such a connector assembly would enable a vertically-cast insulated concrete sandwich wall to be constructed in less time, with less labor and with the possibility of reducing the number of operators required to construct the wall.

SUMMARY OF THE INVENTION

The invention consists of a through-insulation connector assembly for use in the construction of insulated concrete sandwich walls. The connector assembly includes a spool-shaped connector body comprising two, interconnecting pieces and a tie that engages the connector body. The two pieces of the connector body are installed at the place of manufacture in a sheet of foam insulation that will be used as the insulation layer in the construction of an insulated concrete sandwich wall. The two pieces of the connector body each have a flange portion and a stem portion. The two pieces are axially aligned on opposite faces of the foam sheet with their stem portions facing the foam sheet. The two pieces are moved toward each other along their mutual axes until they are in contact engagement. The stem portions are dimensioned so that, upon mutual contact engagement, the flange portions will each engage the corresponding face surface of the foam sheet. The connector body includes an axial through-bore which receives the tie. Cooperative engagement surfaces of the tie and connector body permit the tie to be inserted and oriented to restrain the tie in an engagement relationship with the connector body.

In use of the through-insulation connector assemblies of the present invention, a plurality of the two-piece connector bodies are installed in the foam sheet at the place of manufacture. The foam sheet with installed connector bodies is shipped to the location where the wall will be constructed. Assembly of the wall form and insulation layer is simplified in that the foam sheet is stood in place next to a steel reinforcing grid adjacent an erected wall form. The second reinforcing cage is put in place adjacent the foam sheet and the ties are inserted into the connector bodies from the exposed side of second reinforcing cage and oriented to engage the tie and the connector body. The opposite wall form is erected and concrete is poured on either side of the insulating layer. In an alternative construction process using the present invention, the first wall form is erected and then both of the reinforcing grids are positioned. The foam sheet including the installed connectors is then lowered or laterally shifted into place between the two reinforcing grids. As in the other embodiment, the ties are then inserted into the connectors from the exposed side of the second reinforcing grid and then the second wall form is erected and the concrete is poured.

In a preferred embodiment of the invention, the two pieces of the connector body have interlocking surfaces which permit the two stem potions to be pushed together until the interlocking surfaces are engaged and thereafter prevent the pieces from being separated. Alternatively, the two pieces may be held in contact during assembly and then secured to each other by, for example, sonic, spin, or other welding or adhesives.

In a further embodiment, the cooperative engagement surfaces on the connector body and the tie also act to provide a stop or reference point for the preferred depth that the tie is to be inserted in the connector body. The stop or reference point will assure that the ties are all inserted in the connector bodies at a uniform depth. Uniform installation of the ties will assist in positioning the insulating layer at the desired location spaced from the two wall forms.

In another embodiment, graspable projections are formed in the end portion of the tie that is not inserted into the connector body to assist the operator in generating the force needed to orient the tie to engage it with the connector body.

An object of the invention is to provide a through-insulation connector assembly for use in constructing insulated concrete sandwich walls.

Another object of the invention is to provide a through-insulation connector assembly for use in constructing insulated concrete sandwich walls that is partially installed during manufacture to reduce the labor required in the wall construction process.

A further object of the invention is to provide a through-insulation connector assembly for use in constructing insulated concrete sandwich walls which simplifies the wall construction process.

Yet another object of the invention is to provide a through-insulation connector assembly for use in constructing insulated concrete sandwich walls that reduces the time and expense of constructing the walls.

These and other objects of the invention will be appreciated by those of skill in the art upon a review of this specification, the associated drawings, and appended claims.

DETAILED DESCRIPTION OF THE PREFERRED EMBODIMENTS

The present invention comprises a novel through-insulation connector assembly for use in the construction of insulated concrete sandwich wall and an improved method of constructing insulated concrete sandwich walls using the connector assembly. A preferred embodiment of the connector assembly includes a spool-shaped connector body comprised of two, interconnecting pieces and a tie that engages the connector body. The two pieces of the connector body are installed at the place of manufacture in a sheet of foam insulation that will be used as the insulation layer in the construction of an insulated concrete sandwich wall. The two pieces of the connector body each have a flange portion and a stem portion. The two pieces are axially aligned on opposite faces of the foam sheet with their stem portions facing the foam sheet. The two pieces are moved toward each other along their mutual axes until they are in contact engagement. The stem portions are dimensioned so that, upon mutual contact engagement, the flange portions will each engage the corresponding face surface of the foam sheet. The connector body includes an axial through-bore which receives the tie. Cooperative engagement surfaces of the tie and connector body permit the tie to be inserted and oriented to restrain the tie in an engagement relationship with the connector body. In use of the through-insulation connector assemblies of the present invention, a plurality of the two-piece connector bodies are installed in the foam sheet at the place of manufacture. The foam sheet with installed connector bodies is shipped to the location where the wall will be constructed. Construction of the insulated concrete sandwich wall is simplified in that the connector pieces are already installed in the foam sheet and the ties are installed preferably after the foam sheet has been positioned.

Figure 1:
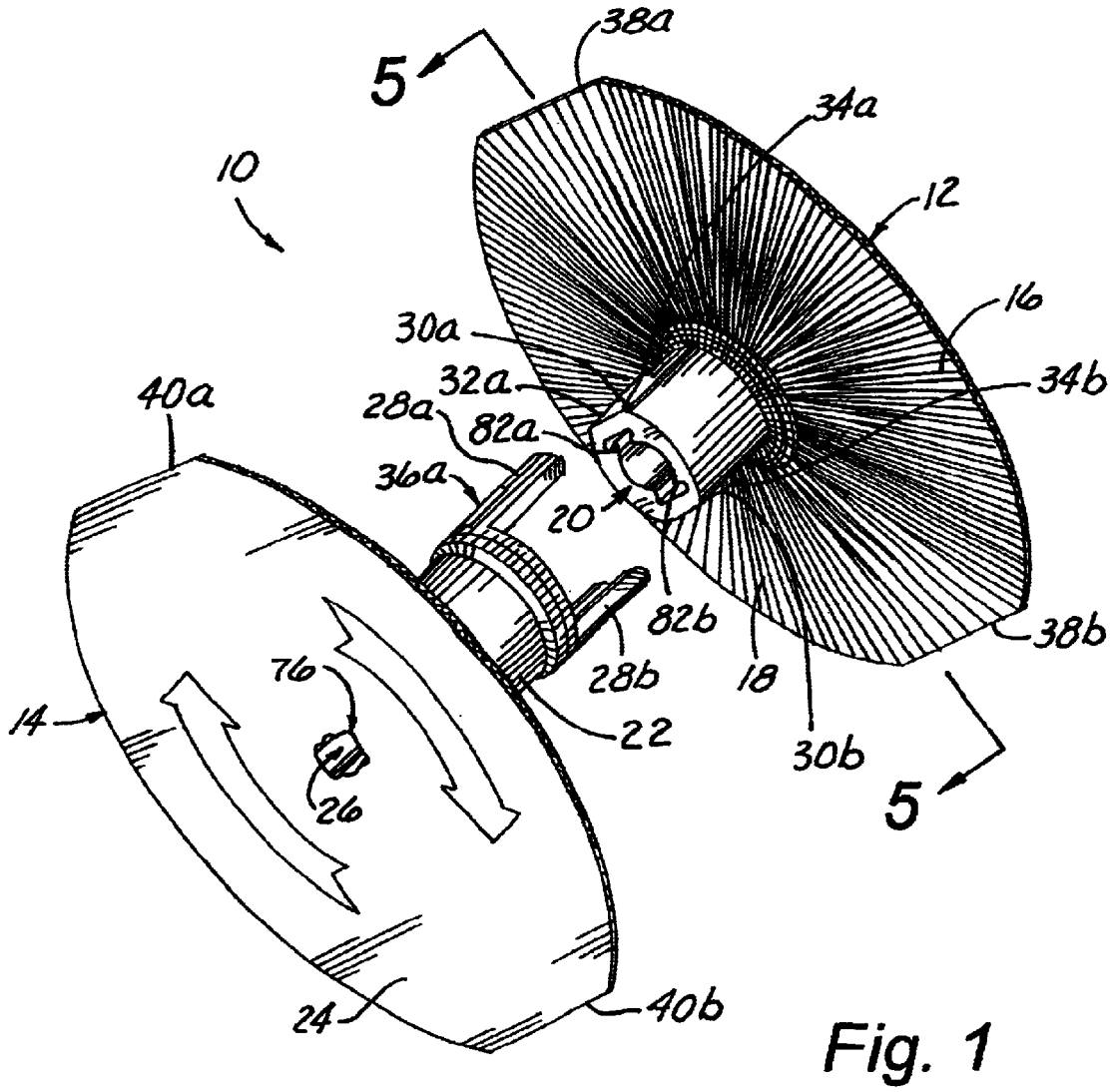
FIG. 1 is a perspective view of two pieces of a connector body of the present invention prior to assembly of the two pieces.

Illustrated in FIG. 1, generally at 10, is a spool-shaped connector body of the present invention, comprised of two, interlocking pieces, male spool piece 12 and female spool piece 14. Male spool piece 12 includes a generally circular flange portion 16 and a projected stem portion 18. A throughbore 20 is located on the axial centerline of the stem portion 18 and passes through the center of the flange portion 16. Similarly, the female spool piece 14 includes a projected stem portion 22, a generally circular flange portion 24, and an axial throughbore 26.

Interlocking of the male piece 12 and female piece 14 is achieved by cooperating elements on the stem portions 18 and 22. Specifically, stem portion 22 of the female piece 14 terminates in a pair of diametrically facing locking clips 28*a* and 28*b* which form a latch, and stem portion 18 of the male spool piece 12 presents radially extended, opposed retaining ears 30*a*, 30*b* which form a detent. Each of the retaining ears 30*a*, 30*b* has a profile that includes a ramp 32*a*, 32*b* and a stop 34*a*, 34*b*, respectively. Each of the locking clips 28*a*, 28*b* includes a locking aperture 36*a*, 36*b*, respectively, and are separated by a distance corresponding closely to the width of the stem portion 18. Locking clips 28*a*, 28*b* have sufficient flexibility such that when the two spool pieces 12 and 14 are axially aligned with their stem portions facing each other, movement of the spool pieces 12 and 14 toward each other will cause the locking clips 28*a*, 28*b* to spread slightly in sliding engagement with the outer periphery of the stem portion 18. If the spool pieces 12 and 14 have been pivoted to align the locking clips 28*a*, 28*b* with the retaining ears 30*a*,30*b*, the locking clips 28*a*, 28*b* will slide on the ramps 32*a*, 32*b* until they pass the stops 34*a*, 34*b*, whereupon they will return to their relaxed position with the ears 30*a*, 30*b* extended into the apertures 36*a*, 36*b*. The locking clips 28*a*, 28*b* are restrained by the stops 34*a*, 34*b* from permitting separation of the spool pieces 12 and 14 from their interlocked condition.

Prior art connector assemblies are installed in the foam sheet of insulation at the site where the wall is being constructed. Typically, holes have been formed in the foam sheet where the connector assemblies are to be inserted. These connectors have one or more substantially planar flange members one of which is threaded over the tie and the other is positioned up against the foam sheet on the opposite side and centered over a hole. The tie includes a retaining member that prevents the first flange from being removed from the tie and allows unidirectional insertion of the tie through the second flange, thereby holding the flanges up against the faces of the foam sheet, with a central portion of the tie passing through the hole in the foam sheet. Because the tie is required to hold the flanges in position on the foam sheet, these connectors cannot practically be pre-assembled because the projecting ends of the ties would greatly increase the volume of the insulating layer to be shipped to the wall construction site.

The through-insulation connectors 10 of the present invention are self-connecting, making it practical to install the connectors 10 in the foam sheet by inserting the stem portions of a male piece 12 and a female piece 14 into opposite ends of a pre-formed hole in the foam sheet, aligning the connector pieces, and pressing the pieces 12 and 14 together to the interlocked position. The flange portions 16 and 24 have substantially planar surfaces opposite the stem portions. Therefore, flange portions 16 and 24 add little if anything to the thickness or volume of the foam sheet when installed at the manufacturing site. Further, the foam sheet may be partially compressed in the area of the flange portions 16 and 24 during the assembly of the connectors 10. Alignment of the spool pieces 12 and 14 so that they will interlock when pressed together is facilitated by diametrically opposed shoulders 38*a*, 38*b* and 40*a*, 40*b* formed in the flange portions 16 and 24, respectively. In the illustrated embodiment, shoulders 38*a*, 38*b* are parallel to the retaining ears 30*a*, 30*b* of the male spool piece 12, and shoulders 40*a*, 40*b* are parallel to the locking clips 28*a*, 28*b*, however, any other consistent relationship can of course be used. An operator, either human or machine, is able to align the cooperative engagement surfaces of the male piece 12 and the female piece 14 by sensing the shoulders 38*a*, 38*b* and 40*a*, 40*b* and making sure that they are aligned or parallel to each other on opposing sides of the foam sheet.

Figure 2:
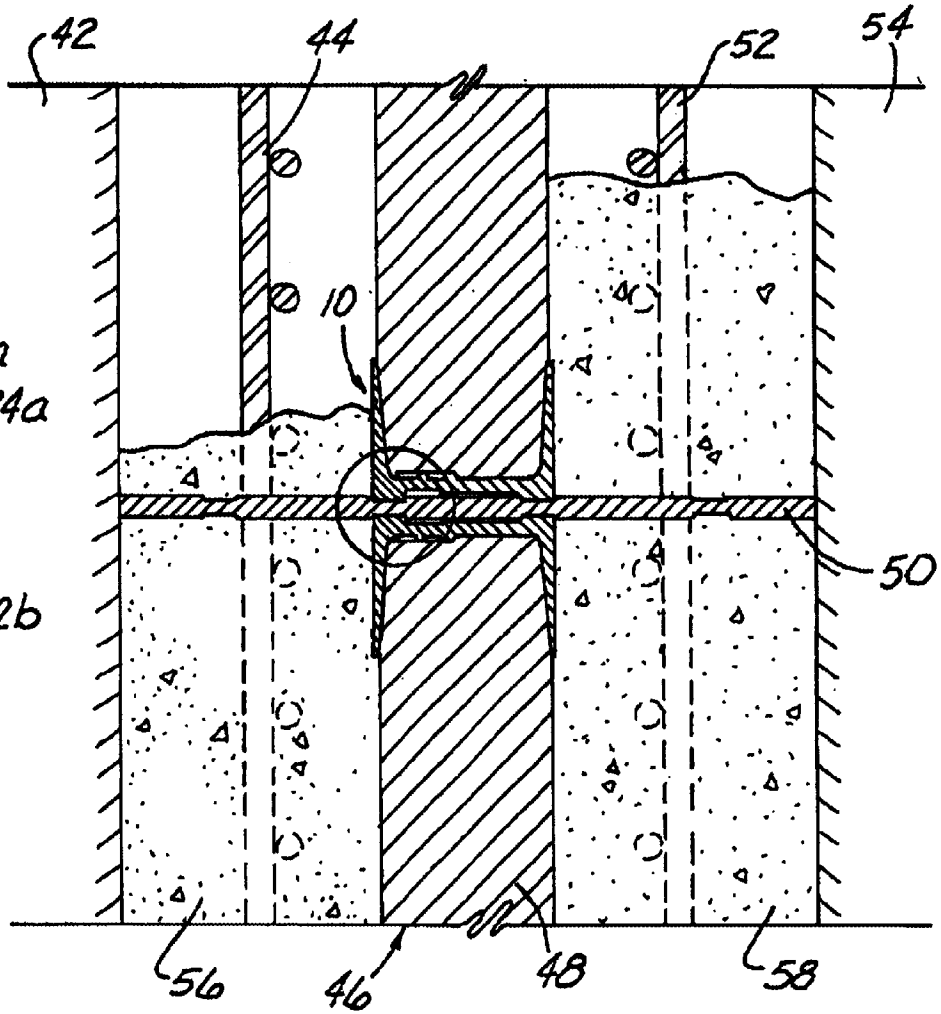
FIG. 2 is a cross-sectional view through an insulated concrete sandwich wall constructed between a pair of wall forms and showing a connector body and associated tie.
Figure 3:
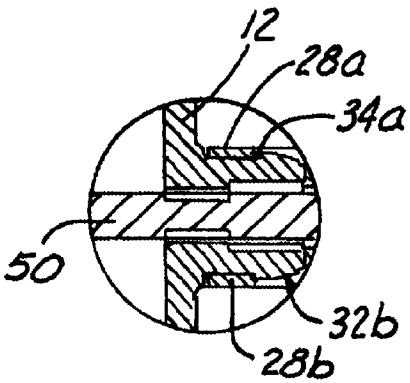
FIG. 3 is an enlarged detail view showing the cooperating engagement surfaces of the connector body and the tie.

Construction of an insulated concrete sandwich wall using the connector assemblies of the present invention begins with the erection of the first of a pair of concrete wall forms 42 (FIG. 2). A first cage or grid 44 of reinforcing steel is positioned parallel to the wall form 42 spaced the distance specified by well-known concrete wall construction standards for the wall being constructed. In some applications, the next step will be to place the insulating layer 46, comprised of a foam sheet 48 in which a plurality of through-insulation connectors 10 have been installed, near the reinforcing grid 44. At this point, a tie 50 is inserted into each of the connectors 10 to a pre-selected depth and oriented by an operator to a retained position as described in more detail below. Since each tie 50 is inserted individually, the binding problem in the prior art associated with trying to thread each of the plurality of projecting tie ends simultaneously through the frequently crowded reinforcing grid is substantially reduced or eliminated. Alternatively, prior to insertion of the ties 50, a second reinforcing grid 52 may be positioned near the insulating layer 46, followed by insertion of the ties 50 from the open or exposed side of the second grid 52. In other applications, the first and second reinforcing grids 44, 52 are positioned as desired prior to placement of the insulating layer 46. In this application, the insulating layer 46 is then lowered or slid into the space between the positioned grids 44, 52, followed by insertion and orientation of the ties 50 as previously described.

Regardless of the construction method that has been applied, following positioning of the two grids 44, 52 and the insulating layer 46, including the ties 50, a second of the pair of concrete forms 54 is erected near the second grid 52. The length of the tie 50 is selected to be near to but slightly less than the spacing of the wall forms 42 and 54 to assist in positioning the insulating layer 46 as desired inside the pair of wall forms 42, 54. While in some applications it may be permissible to allow the ends of the ties 50 to bear on the forming surfaces of both of the wall forms 42 and 54, there are circumstances where bearing of the end of a tie 50 on a wall form 42 or 54 is not desired. For example, elastomeric form liners are sometimes used to create a patterned surface in the concrete wall being formed. Bearing of an end of a tie 50 on the elastomeric material may damage it, resulting not only in a flaw in the instant formed wall surface but also in subsequently formed wall surfaces using the damaged elastomeric liner. Plastic concrete is poured into the regions between the first concrete wall form 42 and one side of the insulating layer 46 and between the second concrete wall form 54 and the opposite side of the insulating layer 46. If there is a concern about an end of a tie 50 bearing on one of the wall forms 42 or 54, the plastic concrete is poured first on the side of concern and a positive relative elevation maintained, thereby biasing the foam sheet and associated ties 50 away from the wall form of concern.

Care is taken not to create too high of a differential head of plastic concrete on opposite sides of the insulation layer 46. The material of the foam sheet 48 is most commonly extruded polystyrene foam, a material relatively weak in resisting the bending and shear stress imposed by lateral loads. While the connectors 10 have a substantial surface area in contact with the faces of the foam sheet 48 and will, in combination with the retained ties 50, help to resist movement of the foam sheet 48 in response to forces created by a differential head of concrete, too great a differential will cause failure of the foam sheet 48 in areas between the connectors 10. Since the head of plastic concrete increases with depth, one accommodation is to space the connectors more closely near the bottom of the foam sheet 48. This concern is present with prior art connector assemblies as well, and experience has shown that a careful operator can avoid exceeding the maximum head differential with little training.

As illustrated in FIG. 2, the end portions of the ties 50 extend away from the foam sheet 48 toward each of the wall forms 42 and 54. The plastic concrete is typically vibrated to reduce the formation of voids in the concrete walls 56 and 58 being formed. Vibration of the plastic concrete thus also assists in consolidating the concrete around the extended end potions of the ties 50, thereby improving the mechanical connection between the ties 50 and the concrete walls 56 and 58 when set.

Figure 4:
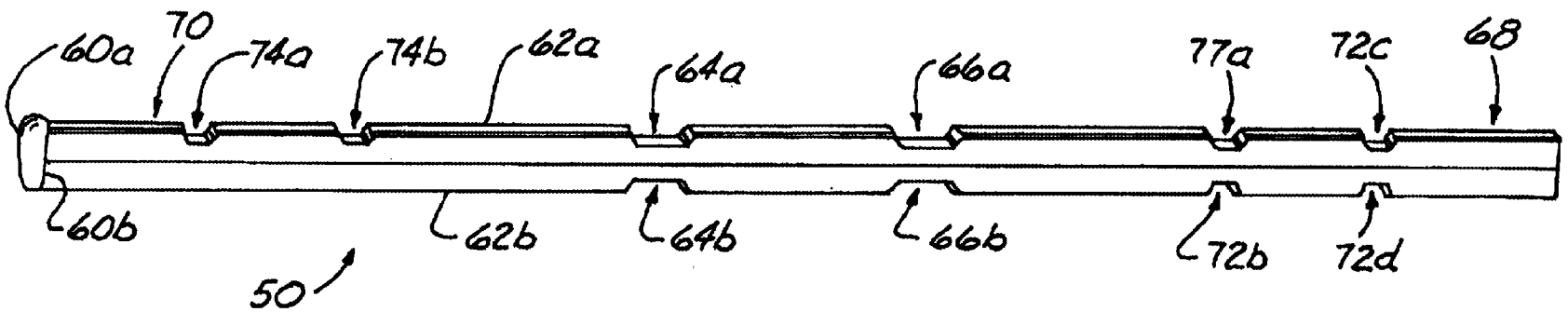
FIG. 4 is a perspective view of a tie.

The rods 50 are, in a preferred embodiment, formed of a fiber-reinforced polymeric material by pultrusion. Alternatively, the ties 50 can be formed of injection molded polymeric material. The ties 50 have low thermal conductivity to minimize thermal transfer between the concrete walls 56 and 58. In a preferred embodiment, the ties 50 have a cross section that includes a pair of parallel side faces 60*a*, 60*b* and two radiused end faces 62*a*, 62*b* (FIG. 4). Alternatively, the ties 50 may have elliptic, oval, or generally rectangular cross sections. Two pair of notches 64*a*, 64*b* and 66*a*, 66*b* are formed in a central portion of the tie 50 by machining or similar process. These notches 64*a*, 64*b* and 66*a*, 66*b* will engage interior portions of the connector 10 upon installation of the tie 50, and thereby serve to define the location, as well as transfer load between the connector 10 and the tie 50. On either side of the central notches 64*a*, 64*b* and 66*a*, 66*b* are end portions 68 and 70. The end potions 68 and 70 may be identical in length, but typically are of different lengths. Notches 72*a–d* are formed in end portion 68 and notches 74*a*, 74*b* are formed in end portion 70. The notches 72*a–d* and 74*a*, 74*b* assist in anchoring of the tie 50 in the concrete walls 56 and 58. In the illustrated embodiment, there are more notches in one end portion than the other, but this is merely a design feature that allows an operator to distinguish one end portion from the other, necessary when end portions of differential length are employed.

Figure 5:
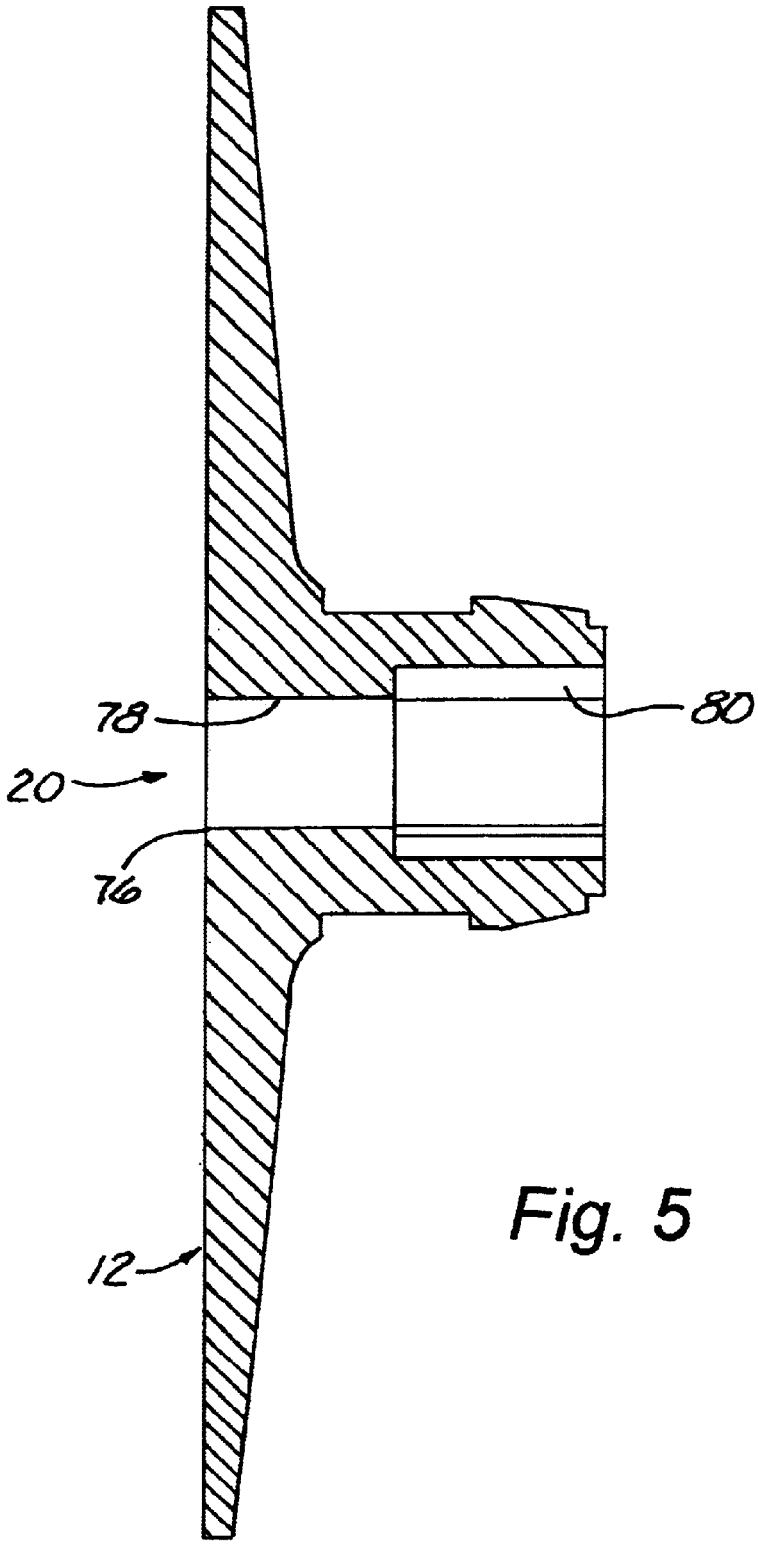
FIG. 5 is a cross-sectional view of a male spool piece of the connector taken along line 5—5 of FIG. 1.

A tie 50 is inserted into an assembled connector 10 by aligning the tie 50 with one of the shaped openings in the flange portions 16 or 24 of the male spool piece 12 or female spool piece 14, respectively, one of which is illustrated in FIG. 1 at 76. Referring to FIG. 5, a cross section of the throughbore 20 of the male spool piece 12 shows that it is provided with a section 78 of restricted clearance at the flange portion and a section 80 of unrestricted clearance at the stem portion. The restricted clearance portion 78 is of a length that closely corresponds to the width of the notches 64*a*, 64*b* and 66*a*, 66*b* of the tie 50. Although not shown, a cross section of the female spool piece 14 would have identical restricted and unrestricted clearance sections. The tie 50 is aligned with the opening 76 and inserted into the connector 10. After it has been inserted to a depth where the notches 64*a*, 64*b* and 66*a*, 66*b* are positioned in the area or the restricted clearance sections, a pivoting force is applied to the tie 50 about its longitudinal axis. Due to the reduced dimension of the tie 50 in the area of the notches 64*a*, 64*b* and 66*a*, 66*b*, which corresponds to the restricted clearance sections, the tie 50 will be allowed to pivot in response to the applied force.

Figure 6:
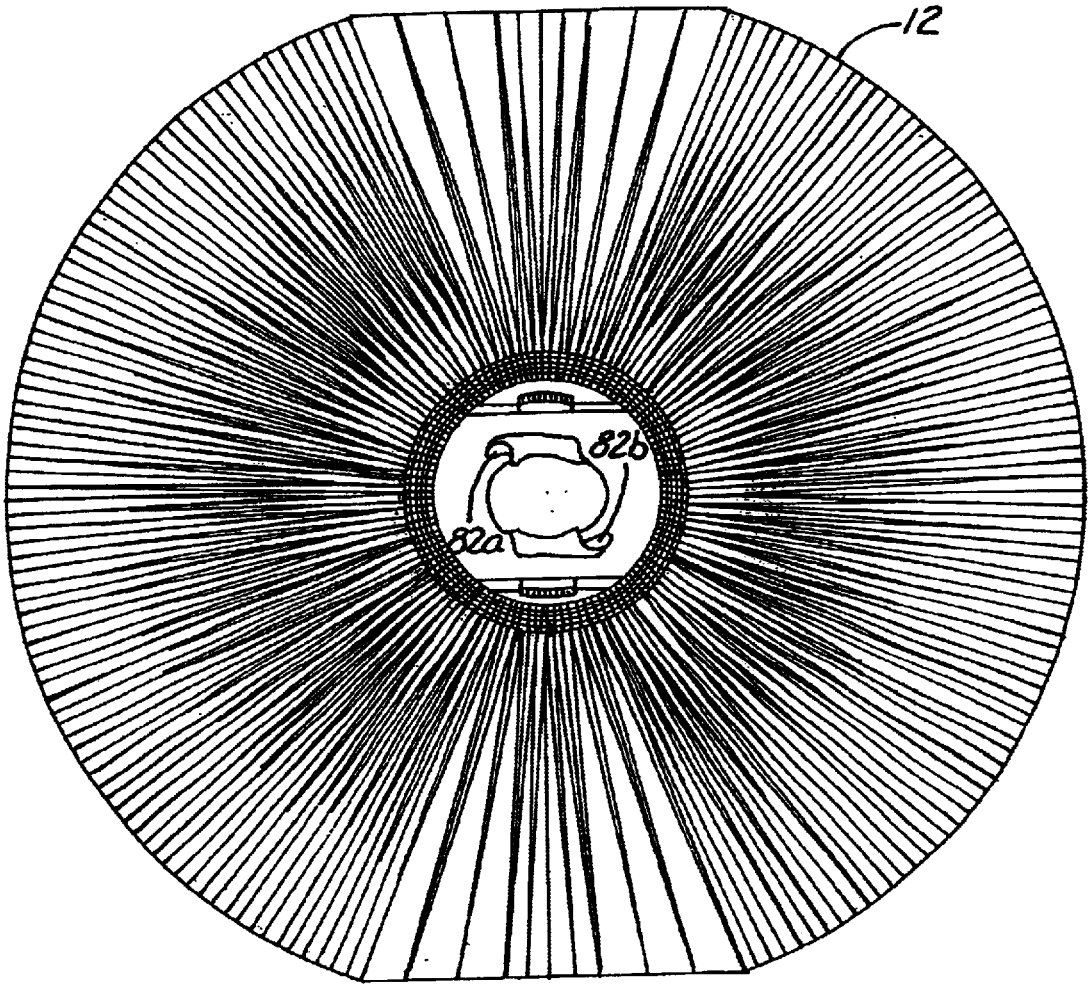
FIG. 6 is an end view of the male spool piece of FIG. 5.

In a preferred embodiment, and as illustrated in FIGS. 1 and 6, a pair of pawls 82*a*, 82*b* are formed in the unrestricted clearance section in the male spool piece 12. In an alternate embodiment, similar pawls may be formed in the corresponding unrestricted clearance section of the female spool piece 14. The pawls 82*a*, 82*b* extend in the desired direction of pivotal movement of the tie 50 after insertion into the connector 10. The pawls 82*a*, 82*b* flex to allow the tie 50 to pivot past them in the preferred direction, but restrict reverse pivotal movement of the tie 50. The pawls 82*a*, 82*b* are positioned and of a length to hold the tie 50 at a position pivoted 90 degrees from its orientation on insertion. When oriented at a substantial angle away from its insertion orientation, the tie 50 cannot be advanced or retracted relative to the connector 10 as the notches 64*a*, 64*b* and 66*a*, 66*b* are trapped by the restricted clearance portions. The pawls 82*a*, 82*b* do not necessarily have to absolutely prevent reverse pivotal movement of the tie 50, but are sufficient if they prevent an excess amount of pivotal movement of the tie 50 in response to vibration of the plastic concrete or the expected jostling of the wall forming elements during construction of the wall. In fact, it may be advantageous to allow an operator to remove the tie 50 if desired. For ease of the operator, arrows 84*a*, 84*b* in the preferred direction of pivotal movement are formed on the flange portions 16 and 24 of the male spool piece 12 and the female spool piece 14, respectively. Of course, a great many pawl or detent arrangements exist in a wide variety of arts that could be employed in the present invention. An alternative to the disclosed pawl arrangement is to provide radially inwardly raised portions on the interior of the thoughbore in the connectors 10 that would flex sufficiently to allow an operator to orient the tie 50 yet would resist undesired pivotal movement of the tie 50 during construction of the concrete wall.

In an alternative embodiment of the tie 50, a hand graspable wing 86 (FIG. 7) is provided on an end portion of the tie 50 to assist the operator in applying a pivoting force to the tie 50. As an alternative, a simple installation tool could be used. The tool would be of an easily hand graspable size and shape, such as a cylinder and would have a longitudinal tie pocket open at one end of the tool. The tie pocket would be sized to accept an end portion of the tie 50, allowing the tie 50 to be inserted into the tool until the end of the tie came into contact with the closed end of the tie pocket, thus setting the depth of the tie upon insertion into a connector 10. Engagement surfaces on the inside of the tie pocket would prevent the tie from pivoting inside the tool. Accordingly, pivotal movement of the tool would result in pivotal movement of the tie.

Figure 8:
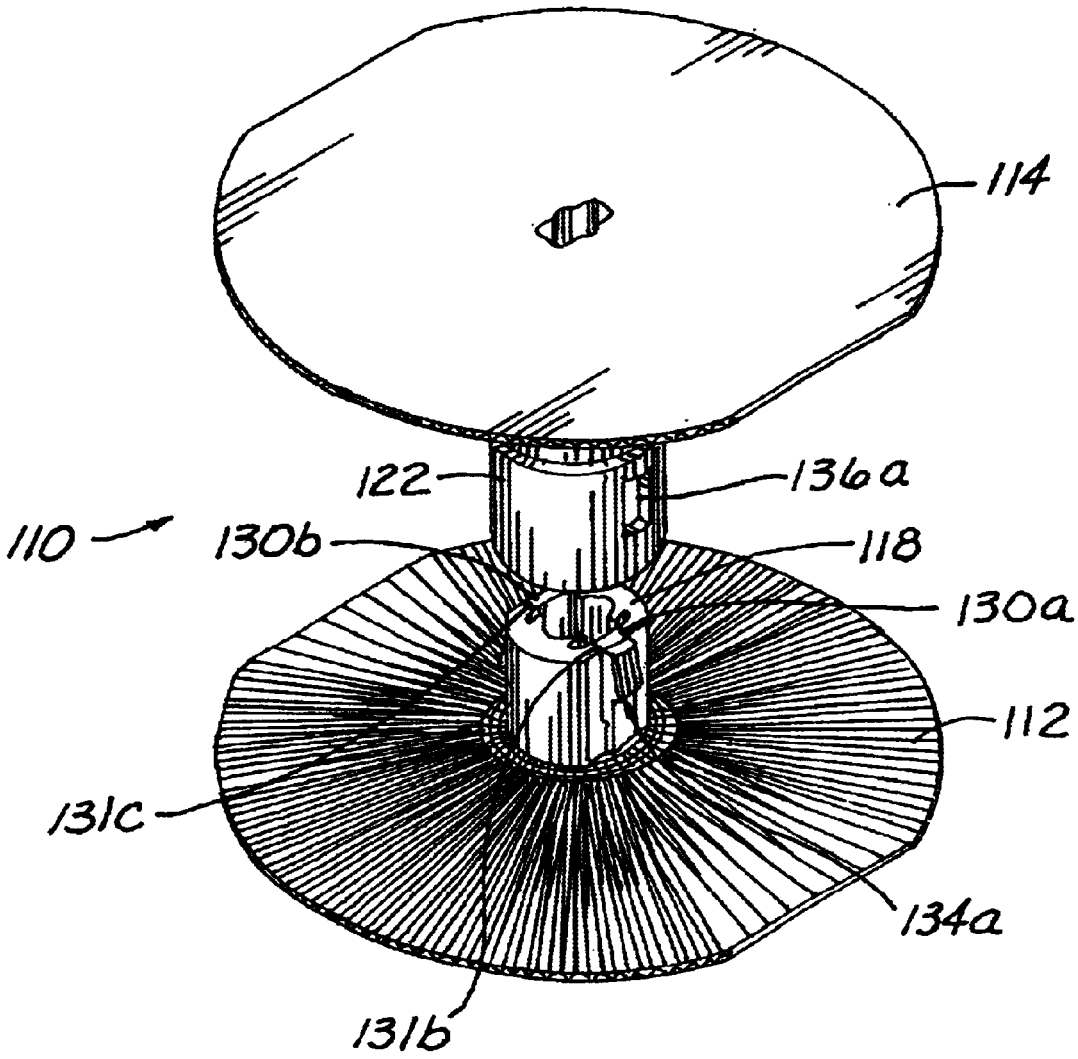
FIGS. 8–12 are perspective views of alternative embodiments of the connector.

An alternative embodiment of the connector is illustrated in FIG. 8, generally at 110. Also comprising a male spool piece 112 and a female spool piece 114, the connector 110 differs from the connector 10 in the arrangement of the cooperative interlocking engagement members. In connector 110, the stem portion 122 of the female spool piece 114 is of uniform outer diameter around its entire circumference, with locking apertures 136*a* and 136*b* (not shown). The stem portion 118 of the male spool piece 112 is similar to the stem portion 18 of the connector 10, with the exception that the retaining ears 130*a*, 130*b* are allowed to flex radially inwardly by longitudinal notches 131*a–d* cut in the male stem portion 118 on either side of the retaining ears 130*a*, 130*b*. On assembly of this connector 110, when the female stem portion 122 is received about the male stem portion 118, the retaining ears 130*a*, 130*b* will flex radially inwardly, until the apertures 136*a*, 136*b* are moved past the corresponding stop 134*a*, 134*b*, whereupon the retaining ears 130*a*, 130*b* will return to their radially extended position, interlocking the male spool piece 112 and the female spool piece 114 to form the connector 110.

Figure 9:
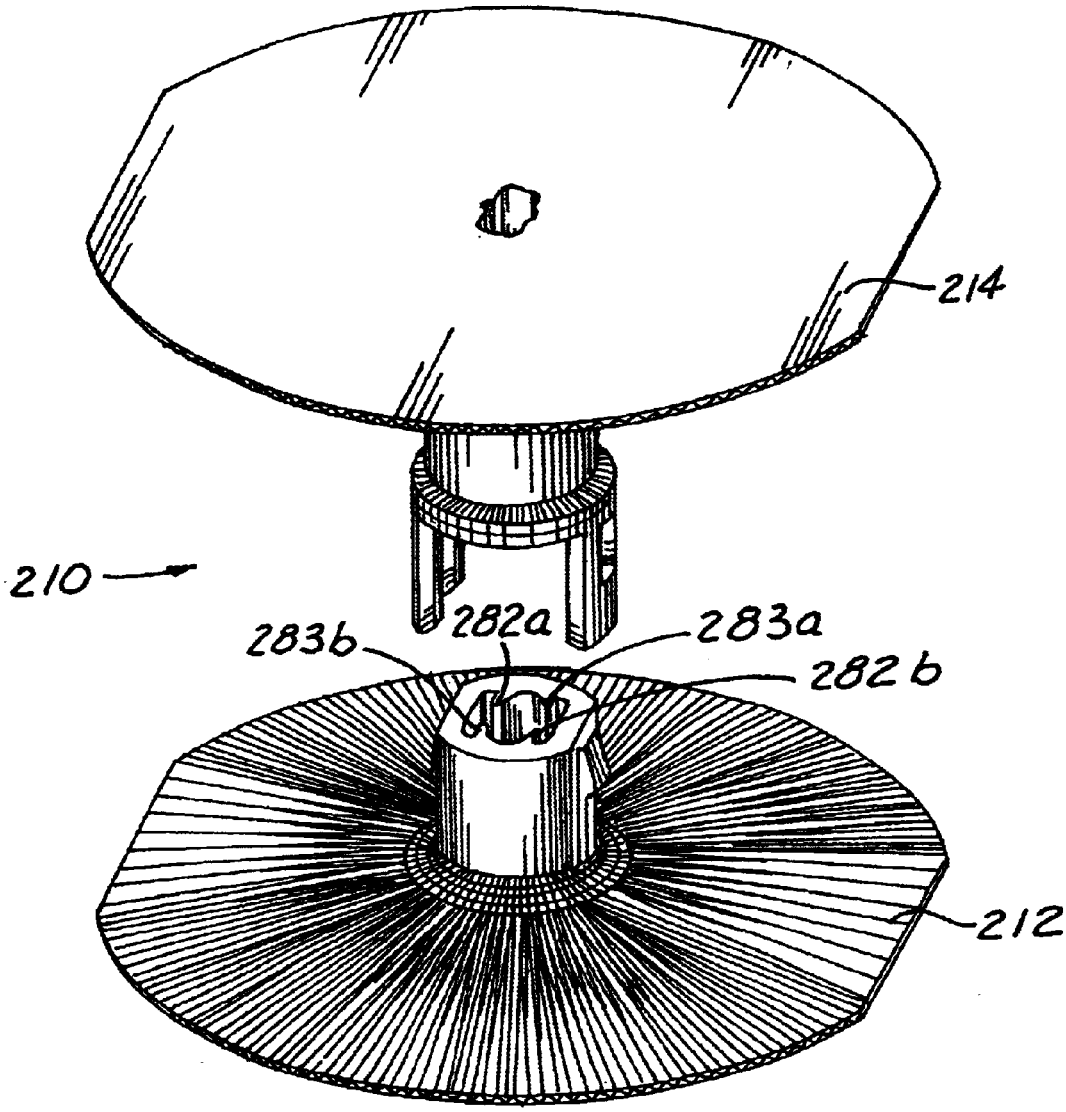

Another alternative embodiment of the connector is illustrated in FIG. 9, generally at 210. This embodiment is identical to connector 10 except that two pair of pawls 282*a*, 282*b* and 283*a*, 283*b* are provided so that a tie 50 may be pivoted in either direction, thus eliminating the need for directional arrows on the flange portion.

Figure 10:
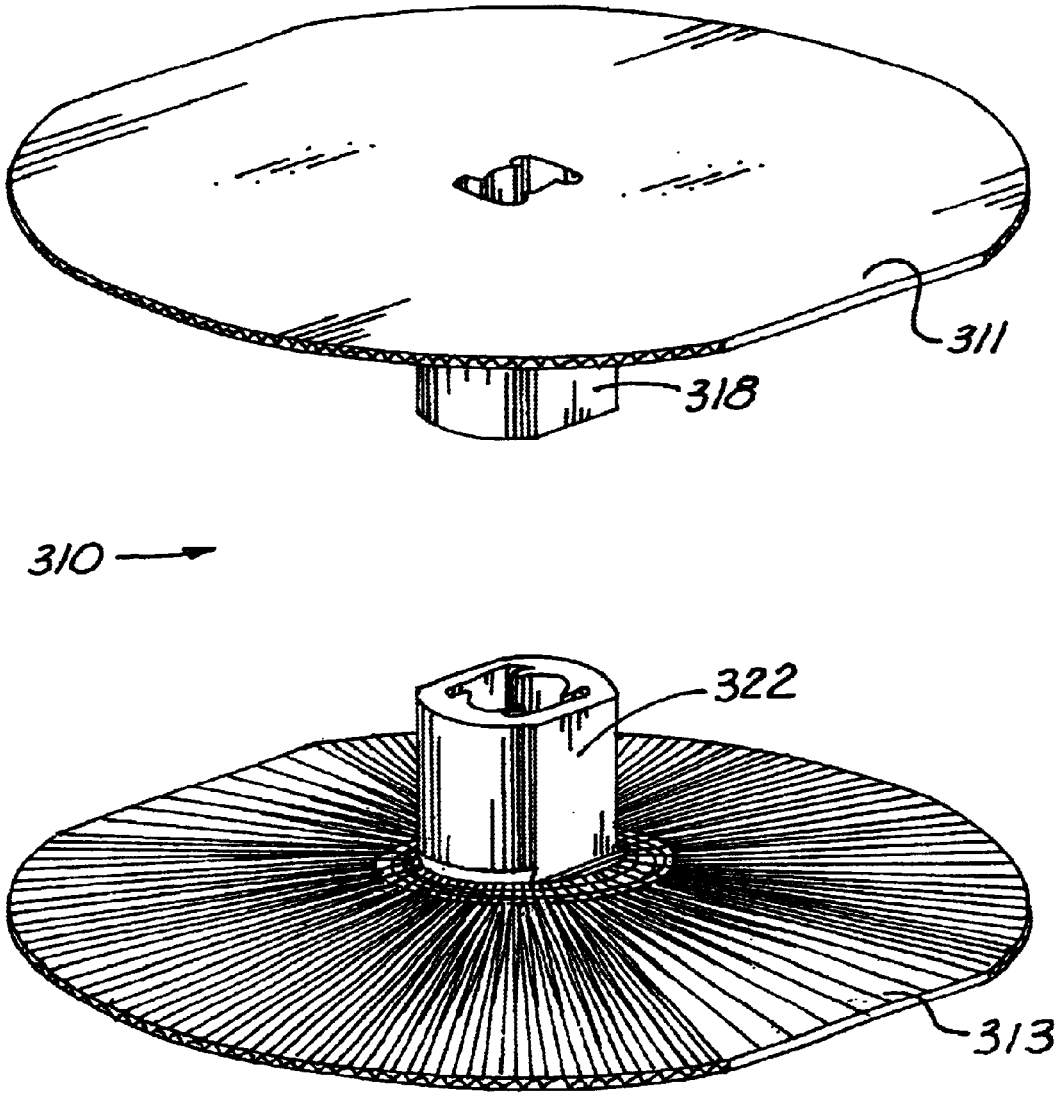

Yet another embodiment of the connector is illustrated in FIG. 10, generally at 310. In this embodiment, there are no cooperating engagement elements that serve to lock the two spool pieces 311 and 313 together. Instead, the stem portions 318 and 322 present flat end surfaces. To assemble the connector 310, the stem portions 318 and 322 are brought into aligned abutting engagement and secured to each other by welding, for example, spinning, staking, hot plate solvent, adhesives, or the like.

Figure 7:
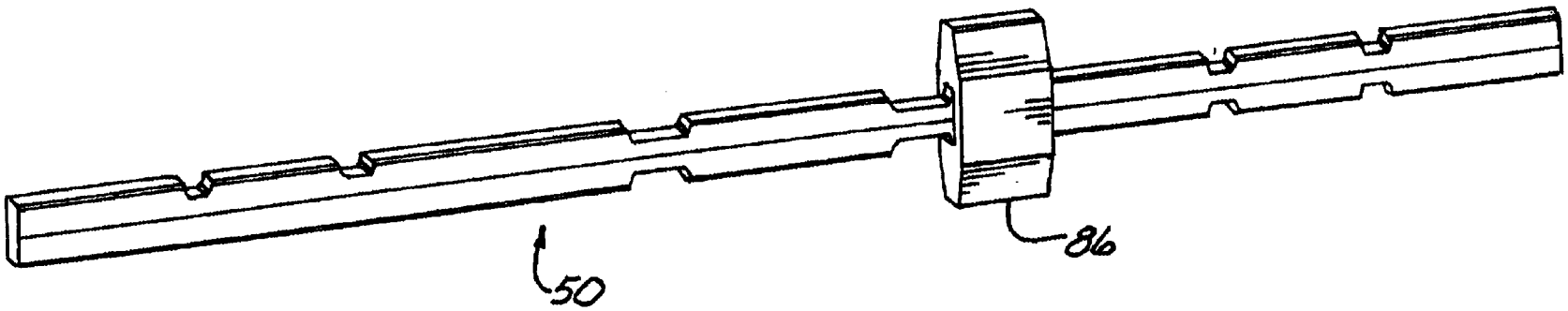
FIG. 7 is a perspective view of a tie on which a hand graspable wing has been over-molded to assist in pivotal movement of the tie.
Figure 11:
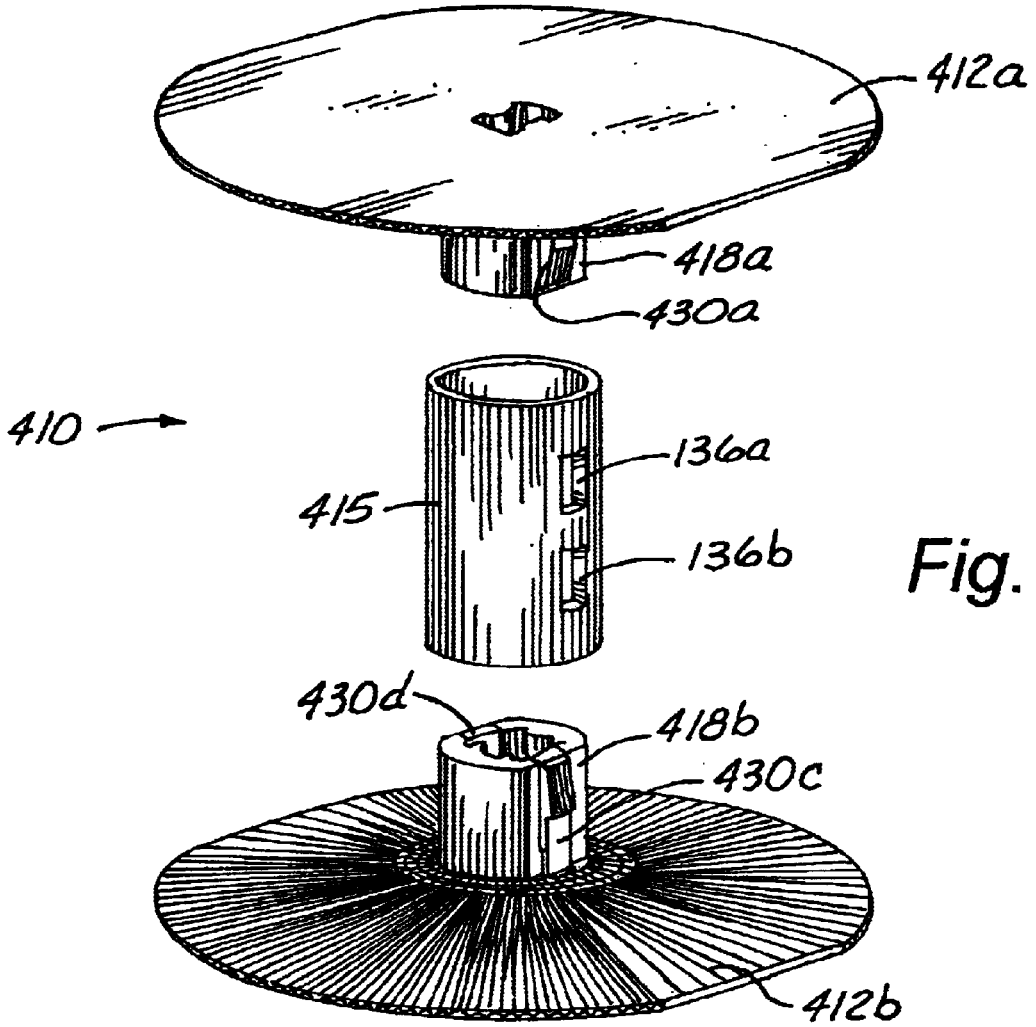

Still another embodiment of the connector is illustrated in FIG. 11, generally at 410. Two identical male spool portions 412*a*, 412*b* are used, each of which is identical to male spool portion 112 (FIG. 7). A docking collar 415 has two pair of locking apertures 436*a*, 436*b* and 436*c*, 436*d* (not shown). As with the connector 110, the stem portions 418*a*, 418*b* will be received inside corresponding end portions of the docking collar 415 and lock into place once the retaining ears 430*a–d* are released into the locking apertures 436*a–d*. An advantage of this embodiment is that the length of the docking collar 415 can be adjusted to match the thickness of the foam sheet, whereas the two male spool pieces 412*a*, 412*b* can remain unchanged.

Figure 12:
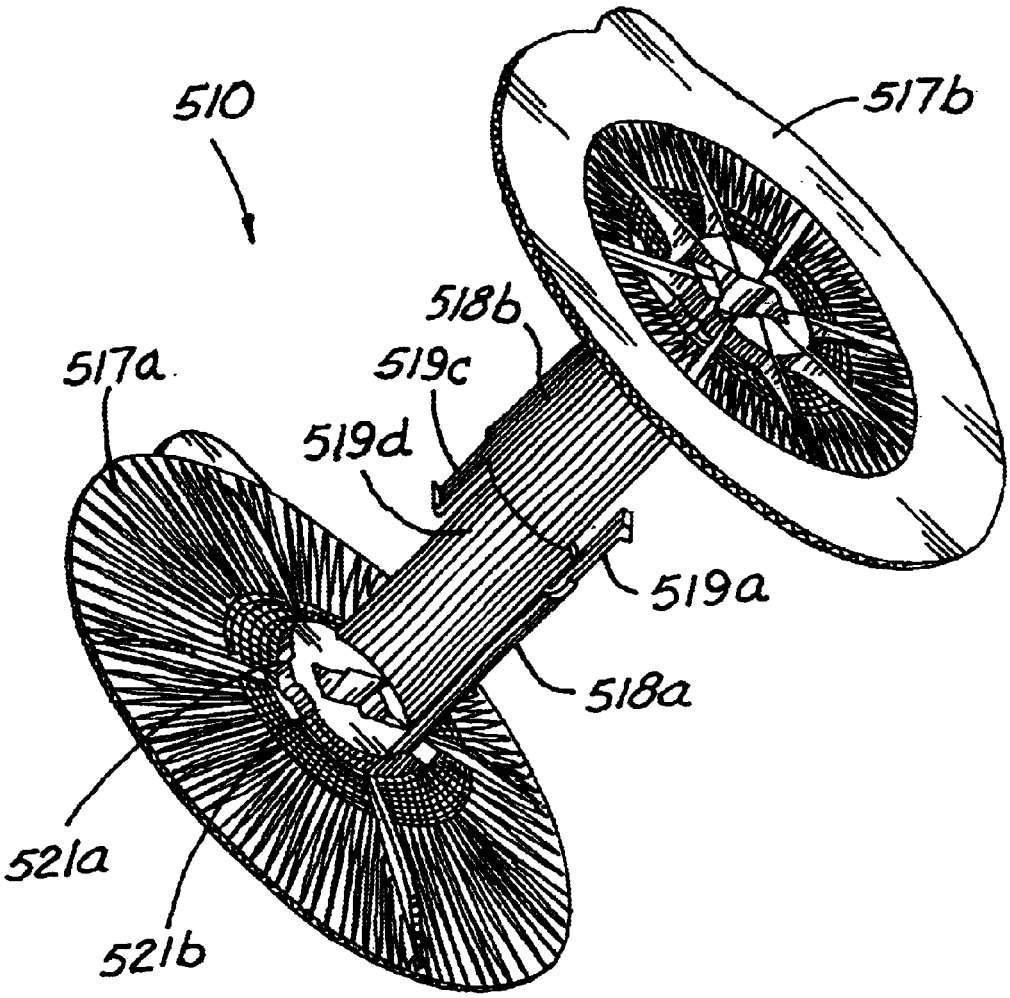

Another embodiment of the connector is illustrated in FIG. 12, generally at 510. The two spool pieces 517*a*, 517*b* are identical to each other. Each has a split stem portion 518*a*, 518*b* with a pair of extended locking tabs 519*a–d*. Corresponding locking apertures 521*a–d* are formed in the flange portions 516*a*, 516*b*. Upon assembly of the two spool pieces 517*a*, 517*b*, the locking tabs 519*a–d* are directed into a corresponding one of the locking apertures 521*a–d*, flexing radially inwardly upon insertion. Once inserted, the locking tabs 519*a–d* will relax to their original dimension being retained inside the locking apertures 521*a–d*, thus interlocking the two spool pieces 517*a*, 517*b* together to form the connector 510.

An additional embodiment of the connector would employ a two-piece connector in which one of the pieces has a stem portion which is of a length corresponding to the thickness of the foam sheet in which it is to be inserted. The other piece has no stem portion, comprising essentially only a flange portion with engagement elements for interlocking the two pieces together. Such an embodiment may be particularly suited for either spin welding or sonic welding as the region to be welded would be close to the surface of the foam sheet and therefore more accessible to the transducer of the sonic welder. A variation of this embodiment provides a latch and detent structure for interlocking the connector piece with the extended stem portion to the flat flange connector. To maintain the important feature of the present invention that the installed connectors not substantially increase the width of the foam sheet, it may be necessary to modify the flange connector and the foam sheet in the area of contact of the flange connector. More specifically, it may be necessary to make the flange connector concave and create a divot in the foam sheet to accommodate the concave flange connector so that the detent and latch elements do not extend substantially above the undisturbed surface of the foam sheet.

Another embodiment comprises a one-piece connector that has a relatively large flange portion only on one side and an extended stem portion that is inserted into the foam sheet. Ribs or some similar frictional engagement structure could be provided to retain the connector in the foam sheet. The connector would, accordingly, only resist lateral forces applied to the foam sheet from the side opposite the flange. Accordingly, care would have to be taken in pouring of the plastic concrete to maintain a positive head on the side of the foam sheet opposite the flange portion. An advantage of such an embodiment would be that the foam sheet could be shipped without any connectors and both the connectors and ties would be installed at the site from the exposed side of the foam sheet. A variation on this embodiment provides the flange and tie to be formed into an integral unit which would be installed in a single step at the wall construction site.

While a variety of cooperative engagement elements of the connector pieces have been described, many other cooperative engagement elements could be used within the scope of the present invention. For example, the two connector pieces could have male and female threads and be assembled by rotating one of the pieces relative to the other about their common axis; a threaded insert could be used in a manner similar to the docking collar; or the two pieces could be interlocked by a press fit.

The foregoing description comprises illustrative embodiments of the present inventions. The foregoing embodiments and the methods described herein may vary based on the ability, experience, and preference of those skilled in the art. Merely listing the steps of the method in a certain order does not necessarily constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention. For example, while the preferred embodiment of the tie has notches formed in it to serve to retain it upon assembly inside a connector, it will be appreciated that the notches could instead be raised portions or lugs formed on the tie. The restricted clearance section and unrestricted clearance sections in the connector would then be reversed, but would function the same to prevent further advancement or retraction of the tie once inserted to the proper depth and pivoted approximately 90 degrees.

What is claimed is:

1. A connector assembly for use in forming insulated concrete sandwich walls having an insulation layer sandwiched between two concrete layers, comprising:

(a) a first connector piece positioned on one side of the insulation layer;

(b) a second connector piece positioned in axial alignment with the first connector piece on the opposite side of the insulation layer;

(c) cooperative engagement elements on the two connector pieces that interlock the two connector pieced together upon movement of the two connector pieces into contact engagement with each other; and (d) a tie inserted into the interlocked connector pieces and having end portions which extend to either side of the insulation layer.

2. A connector assembly as defined in claim 1, wherein the tie is oriented after its insertion in the interlocked connector pieces to prevent its retraction or further advancement.

3. A connector assembly as defined in claim 2, wherein in the tie is pivoted to prevent its retraction or further advancement.

4. A connector assembly as defined in claim 2, wherein hand graspable projections are provided on the tie to facilitate its orientation.

5. A connector assembly as defined in claim 1, further comprising retaining elements on either the first or second connector piece for retaining the tie in position inside the interlocked connector pieces after its insertion.

6. A connector as defined in claim 5, wherein the tie is oriented after its insertion in the interlocked connector pieces to prevent its retraction or further advancement and the orientation of the tie engages the retaining elements.

7. A connector as defined in claim 1, wherein the cooperative engagement elements comprise a detent and latch, one of which is on the first connector piece and the other of which is on the second connector piece.

8. A connector as defined in claim 7, wherein the detent comprises a fixed ear and the latch comprises a flexible clip that passes over the fixed ear as the pieces are moved toward the interlocked position and which engages the ear in the interlocked position to prevent disengagement of the two interlocked pieces.

9. A connector as defined in claim 1, wherein the cooperative engagement elements comprise a detent and latch associated with each connector piece wherein the detent of the first piece is engaged by the latch of the first piece upon movement of the two pieces toward the interlocked position to prevent disengagement of the two interlocked pieces.

10. A connector assembly for use in forming insulated concrete sandwich walls having an insulation layer sandwiched between two concrete layers, comprising:

(a) a first connector piece positioned on one side of the insulation layer;

(b) a second connector piece positioned in axial alignment with the first connector piece on the opposite side of the insulation layer, (c) cooperative surfaces on the two connector pieces that abut each other upon movement of the two connector pieces into contact with each other;

(d) means securing the first and second connector pieces to each other at the cooperative surfaces to interlock the pieces together; and (e) a tie inserted into the interlocked connector pieces and having end portions which extend to either side of the insulation layer.

11. A connector assembly as defined in claim 10, wherein the securing means comprises welding.

12. A connector assembly as defined in claim 10, wherein the securing means comprises an adhesive.

13. A connector assembly for use in forming insulated concrete sandwich walls having an insulation layer sandwiched between two concrete layers, comprising:

(a) a first connector piece positioned on one side of the insulation layer;

(b) a second connector piece positioned in axial alignment with the first connector piece on the opposite side of the insulation layer;

(c) a docking member positioned in axial alignment between the first and second connector pieces;

(d) cooperative engagement elements on the two connector pieces and the docking member that interlock the two connector pieces to the docking upon movement of the two connector pieces into contact engagement with the docking member; and (e) a tie inserted into the interlocked docking member and connector pieces and having end portions which extend to either side of the insulation layer.

14. A method of constructing an insulated concrete sandwich wall having an insulation layer sandwiched between two concrete layers, comprising the steps of:

(a) positioning a first connector piece on one side of the insulation layer;

(b) positioning a second connector piece on the opposite side of the insulation layer in axial alignment with the first connector piece;

(c) providing cooperative engagement elements of the two connector pieces;

(d) moving the two connector pieces into contact engagement whereupon the cooperative engagement elements interlock the two connector pieces together; and (e) inserting a tie into the interlocked connector pieces-to a depth where end portions extend to either side of the insulation layer.

15. A method as defined in claim 14, further comprising the step of orienting the tie after its insertion into the interlocked connector elements to prevent its retraction of further advancement.

* * * * *

UNITED STATES PATENT AND TRADEMARK OFFICE

CERTIFICATE OF CORRECTION

PATENT NO. : 6,945,506 B2
DATED : September 20, 2005
INVENTOR(S) : Long, Sr.

It is certified that error appears in the above-identified patent and that said Letters Patent is hereby corrected as shown below:

Title page,
Item [75], Inventor, should read -- Robert T. Long, Sr., Ames, Iowa (US) --.

Signed and Sealed this

Eighth Day of November, 2005

JON W. DUDAS
*Director of the United States Patent and Trademark Office*